US005941110A

United States Patent [19]

Cao et al.

[11] Patent Number: 5,941,110

[45] Date of Patent: Aug. 24, 1999

[54] ADAPTIVE METHOD AND APPARATUS FOR FORMING TAILOR WELDED BLANKS

[75] Inventors: Jian Cao, Wilmette, Ill.; Brad L. Kinsey, Clio, Mich.

[73] Assignee: Northern University, Evanston, Ill.

[21] Appl. No.: 08/854,480

[22] Filed: May 12, 1997

[51] Int. Cl.[6] ..... B21B 37/00

[52] U.S. Cl. ..... 72/21.4; 72/349; 72/350; 72/312; 72/379.2; 72/20.1; 72/20.2

[58] Field of Search ..... 72/15.1, 16.1, 72/17.3, 18.1, 19.1, 20.1, 20.2, 21.4, 21.1, 21.5, 347, 350, 351, 379.2, 709, 311–313; 228/155, 157

[56] References Cited

U.S. PATENT DOCUMENTS

| | | | |
|---|---|---|---|
| 4,779,443 | 10/1988 | Hoshi | 72/350 |
| 5,138,857 | 8/1992 | Siegert . | |
| 5,148,696 | 9/1992 | Visscher . | |
| 5,477,723 | 12/1995 | Kergen | 72/350 |
| 5,528,918 | 6/1996 | Kirii | 72/15.1 |
| 5,600,991 | 2/1997 | Munzen | 72/350 |
| 5,706,696 | 1/1998 | Wagner | 72/351 |
| 5,735,201 | 4/1998 | Hirao et al. | 72/351 |

OTHER PUBLICATIONS

Closed Loop Binder Force System, pp. 143–150; Society of Automotive Engineers, Inc., K. Siegert, S. Wagner and M. Ziegler.

CNC Hydraulic Multipoint Blackholder System For Sheet Metal Forming Presses; 4 pages; K. Siegert.

Elastic Deflections Of The Blank Holder In Deep Drawing Of Sheet Metal; J. Materials Processing Technology; 59 (1996), 34–40.

Effect of Rigidity of Die and Press on Blanking Accuracy of Electronic Machined Parts, Annals of the CIRP, vol. 44, p. 319, 1992.

*Primary Examiner*—Joseph J. Hail, III
*Assistant Examiner*—Ed Tolan

[57] ABSTRACT

Method and apparatus for TWB forming with adaptive control of movable punch and/or die segments in a manner to maintain a holding force at the weld line by the punch and die segments during at least initial forming of the blank in a manner to control and limit movement of the weld line. A tailor welded metal blank having a weld line is positioned between a punch and a die with the weld line spanning a cavity defined between the punch and the die. One or more individual segments of the punch and of the die are moved in a manner to engage opposite side regions of the weld line to apply a holding force to the weld line. Relative movement of the punch and/or die segments is adaptively controlled during at least initial deformation of the blank by the punch in a manner to maintain the holding force applied to weld line at a selected holding force value to retain the weld line in a plane defined by the punch and die segments, thereby reducing weld line movement. After initial deformation of the blank by movement of the punch to a preset punch location, the punch and die segments can be retracted away from the weld line during subsequent deformation of the blank.

18 Claims, 3 Drawing Sheets

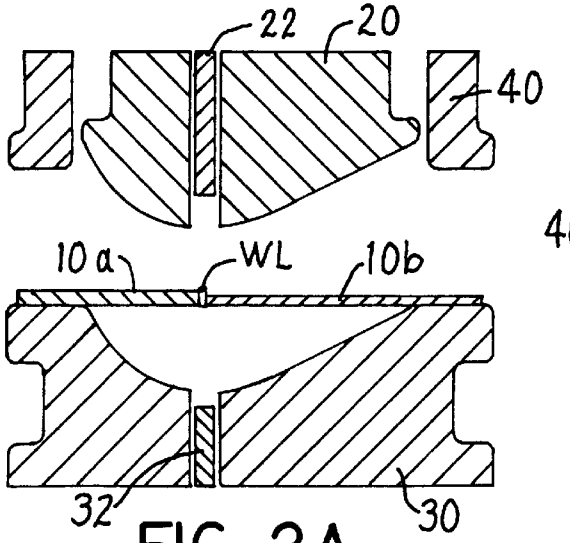
FIG. 2A
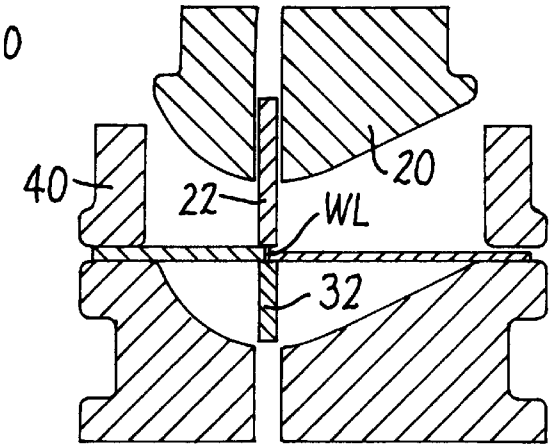
FIG. 2B
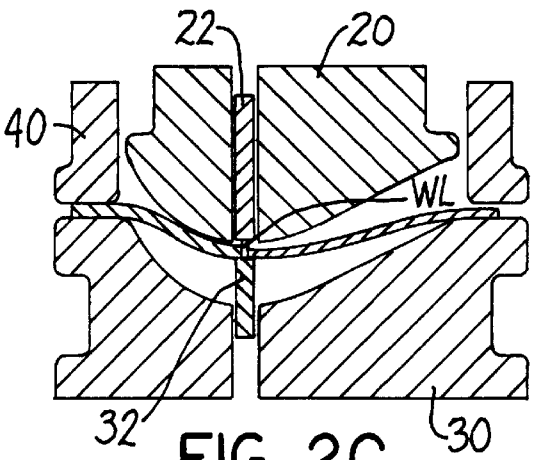
FIG. 2C
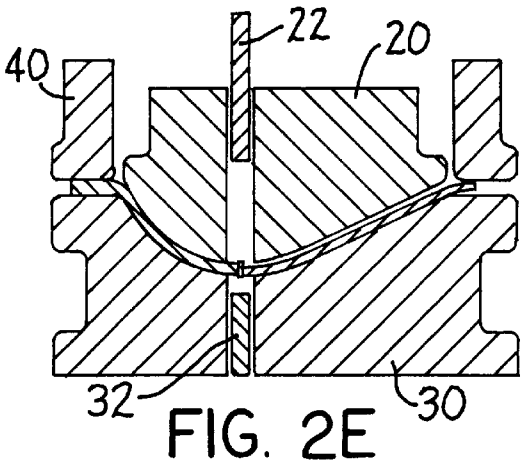
FIG. 2D
FIG. 2E
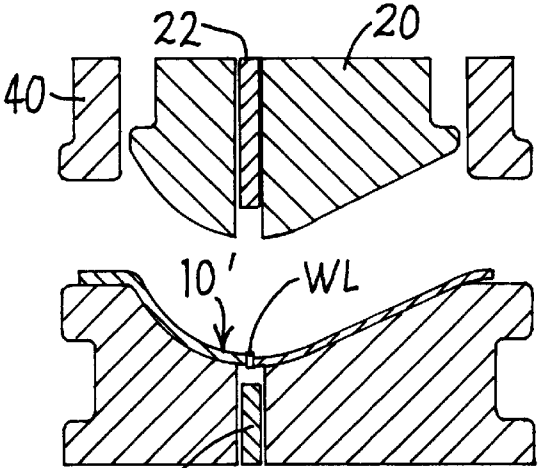
FIG. 2F

ADAPTIVE METHOD AND APPARATUS FOR FORMING TAILOR WELDED BLANKS

FIELD OF THE INVENTION

The present invention relates to forming of a tailor welded blank (two or more material blanks welded together) to a desired shape using a punch and die by imparting a weld line holding force with local adaptive controllers to control and limit movement of the weld line during forming.

BACKGROUND OF THE INVENTION

During the past two decades, governmental fuel conservation and safety mandates along with global competition and environmental concerns have prompted the automotive industry to design lighter vehicles for reduced fuel consumption and reduced manufacturing costs, while improving the overall structure of the vehicle for occupant safety. A relatively new process known as tailor welded blank (hereafter TWB) forming has been developed in an attempt to meet these needs. The TWB forming process replaces the traditional forming-welding sequential process with a welding-forming sequential process. The TWB forming process involves joining various metal sheet sections (e.g. steel sheets) having different properties, such as thickness, strength, etc., into a single welded blank for subsequent forming operation to shape. Therefore, optimum material properties can be located precisely within the formed part where needed for a particular service application. For example, usually, thicker and/or stronger sheet material is used at locations that previously required reinforcement parts. The potential benefits of the TWB forming process include fewer parts, fewer forming dies, fewer spot welds, less material input, and better utilization of sheet metal. Consequently, use of TWB forming processes will result in weight reduction, improved structural integrity, reduced scrap, and most likely lower manufacturing costs and improved dimensional accuracy.

A critical aspect in practicing the TWB forming process concerns movement of the weld line which connects two different sheet materials having different material thickness and/or different strengths. For example, the sheet of weaker material tends to deform more than the sheet of the stronger material, and therefore, the weld line will move toward the stronger material during deformation of the tailor welded blank to shape. Such weld line movement contributes additional potential for tearing, wrinkling, die wear, and distortion and parts dimensional variations when compared to conventional one-blank forming process.

In prior tailor welded blank forming operations, a blank comprising welded sheets is placed between a binder and a die. In the first step of the forming operation, a binder force is applied to the blank periphery to provide a restraining force to the blank through the frictional force from the binder interface plus bending resistance if drawbeads are used. In the second step of the forming operation, a punch is displaced to draw the blank under the binder into the forming zone and to plastically deform the blank into desired shape. The optimal placement of the weld line(s) is selected mainly to meet requirements of safety and integrity of the formed product. Unfortunately, the forming difficulty, in particular weld line movement, introduced by the TWB forming process has resulted in usage of extra thicker/stronger material, thereby reducing the extent of weight and material savings achievable. To overcome this disadvantage, workers have attempted to apply a lower restraining force to the side of the stronger material section of the blank than that applied to the weaker material section of the blank in a conventional one-die forming operation.

For example, different restraining forces on the stronger versus weaker material sections of the tailor welded blank can be applied in a manner described by Siegert et al. in "Closed Loop Binder Force System", SAE paper 960824, 1996, wherein a segmented binder having several individually controllable binders is used in lieu of the traditonal one-piece binder. However, the segmented binder described is not advantageous in that there is a reduction of the rigidity of the overall binder, especially when many binder segments are used, and in that there is a possibility for shear of the material across binder segments. The pressure discontinuities existing across the binder segments may cause earlier failure in the tailor welded blank, since the weld line cannot support the shear deformation as well as the blank base materials.

Another approach which has been described by Jimma and Sekine in "Effect of Rigidity on Blank Accuracy of Electronic Machine Parts" in Annals of the CIRP, pages 319 to 322, 1992, and by Siegert et al. in U.S. Pat. No. 5,138,857 (also see "CNC Hydraulic Multipoint Blankholder System for Sheet Metal Forming Presses", Annals of the CIRP, Volume 42(1), pages 319 to 322, 1993, involves use of a deformable/elastic binder where a relatively thin binder (e.g. about 2 inches in thickness) is set on multiple pins. Each pin is driven by a hydraulic cylinder that generates an adjustable supporting pressure. Due to the elastic compliance of the thin binder, an uneven pressure distribution can be generated and can affect material flow during blank deformation. The use of a deformable/elastic binder in this manner is not advantageous in that controllability on the magnitude of the pressure difference over the entire binder is limited by inherent flexibility of the binder and in that the thin binder may have a relatively low durablity in high volume production. Also see the Shulkin et al. article "Elastic deflections of the blank holder in deep drawing of sheet metal" in Journal of Materials Processing Technology, pages 34 to 40, 1996.

Still another approach to mitigating weld line movement involves use of different drawbead heights/shapes or binder radii on two opposite sides of the weld line so that the stonger material section of the blank can flow into the deformation zone more easily that the weaker material section of the blank. These techniques are disadvantageous in that control is difficult and there is more material waste.

A common feature of the aforementioned approaches to TWB forming is that movement of the weld line(s) of the blank is determined by the binder design and/or applied peripheral blank restaining pressure or force which alters the amount of material drawn into the die cavity. Another common feature is that attempted control of weld line movement occurs remote from the weld line(s) and deformation zone, thus inherently limiting the extent to which weld line movement can be controlled.

Furthermore, the aforementioned approaches may not be effective when a nonlinear (curvilinear) weld path and/or multiple weld lines are present in the tailor welded blank. For example, the lower binder force might be beneficial to one weld line, or the material flow in in one direction, but meanwhile could be undesirable for another weld line in another direction.

An object of the present invention is to provide method and apparatus for locally holding a weld line(s) of a tailor welded blank during at least initial forming thereof (where it has been discovered that most of the weld line movement occurs) so as to control and limit movement of the weld line in a manner that reduces movement of the weld line and overcomes the aforementioned disadvantages of the TWB forming processes described hereabove.

SUMMARY OF THE INVENTION

The present invention involves method and apparatus for TWB forming in a manner to maintain a holding force at the weld line by movable punch and die segments during at least initial forming of the blank in a manner to control and reduce movement of the weld line.

In practicing an embodiment of the present invention, a tailor welded metal blank having a weld joint or line is positioned between a punch and die with the weld line spanning a die cavity. One or more individual segments of the punch and of the die are moved in a manner to engage opposite side regions of the weld line to apply a holding force to the weld line. Relative movement of the punch and/or die segments is adaptively controlled during at least initial deformation of the blank by the punch and die in a manner to maintain the holding force applied to the weld line at a selected holding force value to reduce movement of the weld line. After the punch reaches a preset location, the punch and die segments can be retracted away from the weld line during subsequent deformation of the blank when weld line movement does not occur to a harmful extent.

In a particular working embodiment of the present invention, the die segments are moved to engage the weld line, and the punch segments are moved to engage an opposite side of the weld line, the segments applying an initial weld line holding force that is sensed by force sensor(s) at the die segment(s). During initial deformation of the blank by relative movement between the punch and die, the die segment(s) are moved in response to the position of the punch and the punch segments move to maintain the holding force at the preselected stored value and thereby retain the weld line in a plane defined by and containing the punch and die segments.

The objects, features, and advantages of the present invention will become more readily apparent from the following detailed description of the invention taken with the following drawings.

DESCRIPTION OF THE DRAWINGS

FIGS. 2A through 2F schematically illustrate sequential steps in practicing a method embodiment of the present invention.

DESCRIPTION OF THE INVENTION

Referring to FIGS. 1–4, press apparatus for forming a tailor welded metal blank 10 to desired shape is schematically illustrated. For purposes of illustration and not limitation, the metal blank 10 is shown including a relatively thick blank section 10*a* and relatively thin blank section 10*b* joined together by a weld seam or line WL, which may be any conventional weld seam or joint such as laser weld, mash overlap weld, friction weld, butt weld, and the like. The weld line can be linear or non-linear (e.g. curvilinear), and multiple weld lines WL may be present on the blank 10. The blank sections 10*a*, 10*b* may differ in thickness, strength, and/or other mechnical, physical or other properties. The blank sections 10*a*, 10*b* may be the same or different metal including, but not limited to steel, galvanized steel, aluminized steel, aluminum, and others. For example, the thicker blank section 10*a* may be low carbon steel, while the thinner blank section 10*b* may be high strength low alloy steel. The invention is not limited to any particular combination of materials for the blank sections and may be practiced to form a tailor welded blank having one or more linear or non-linear weld lines WL joining two or more blank sections to form a tailor welded blank 10 for forming to desired part shape.

Figure 4:
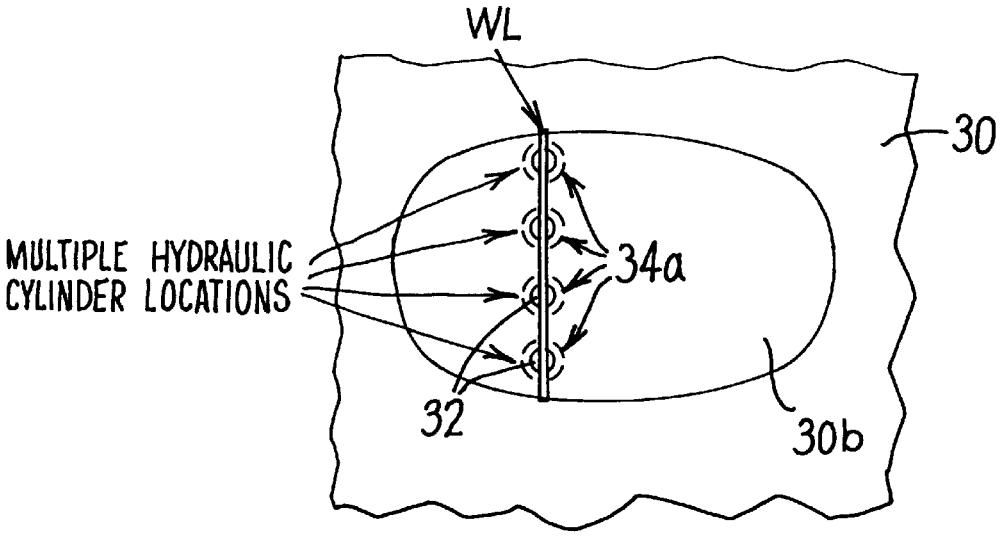
FIG. 4 is a schematic plan view of the die and movable die segments of FIG. 3 with the weld line superimposed thereover.

The press apparatus is shown comprising a movable punch 20 having one or more movable elongated punch segments 22 corresponding in number to the number of die segments and a stationary die 30 having one or more movable elongated die segments 32 (four die segments shown in FIG. 4). The punch and die segments 22, 32 have lower and upper ends, respectively, which may be flat, rounded, or other shape appropriate for engaging opposite side regions of the weld line WL.

The punch 20 includes a punch working surface 20*a* having a configuration corresponding generally to that desired for the shaped part to be formed from the blank. The punch 20 is moved by a hydraulic, mechanical or other conventional actuator 21 toward and away from the stationary die 30 as provided in a conventional mechanical or hydraulic press.

The die 30 includes a die working surface 30*a* having a configuration selected to impart the desired shape to the blank 10 when the blank is deformed by the punch working surface 20*a* against the die working surface 30*a*. The die working surface defines a die cavity 30*b* that receives the punch 20 as the blank 10 is formed to shape against the die as typical in a conventional mechanical or hydraulic press.

A binder 40 is disposed about the punch 20 and is adapted to engage and clamp all or part of the periphery of the blank 10 between the binder 40 and the outer rim 30*c* of the die 30. FIGS. 2B, 2C, 2D, and 2E show the binder engaging the thicker blank section 10*a* with the thinner blank section 10*b* initially unrestrained, although the binder 40 can be configured as desired to clamp all of the blank periphery. The binder can be configured as needed to accommodate and clamp the periphery of blank sections having different shapes and/or thicknesses. The binder 40 can be moved by a hydraulic, mechanical, or other conventional actuator 41 toward and away from the stationary die 30 to this end. The punch and binder typically are moved by the same hydraulic, mechanical or other actuator in a conventional mechanical press.

The punch 20 and die 30 and their segments 22, 32 as well as binder 40 can be made of tool steel or other suitable material to withstand stresses and abrasion associated with the TWB forming operation.

The cylindrical punch segments 22 are received in passages 23 machined in the punch 20 for individual movement therein by a respective hydraulic cylinder 24*a* connected by double-acting piston 24*b* to each cylindrical punch segment 22. Similarly, the cylindrical die segments 32 are received in passages 33 machined in the die 30 for movement therein by a hydraulic cylinder 34*a* connected by double-acting piston

34*b* to each respective die segment 32. A single action hydraulic cylinder with a corresponding modification of the directional valve 25 also can be used in the system to control punch segments 22.

The punch and die segments 22, 32 are aligned on opposite side regions of the weld seam or line WL so as to be in opposing facing relation to hold the weld seam or line WL therebetween as decribed below in a vertical plane defined by and containing the longitudinal axes of the punch and die segments 22, 32. When engaged with the weld seam or line WL, the punch and die segments 22, 32 extend past the respective punch and die working surfaces 20*a*, 30*a*, the die segments extending into the die cavity 30*b* as shown in FIG. 2B, 2C. The punch and die segments can be retracted by the hydraulic cylinders into the passages 23, 33 so as to reside within the respective punch 20 and die 30, FIG. 1 and 2A, 2D, 2E, and 2F.

Figure 1:
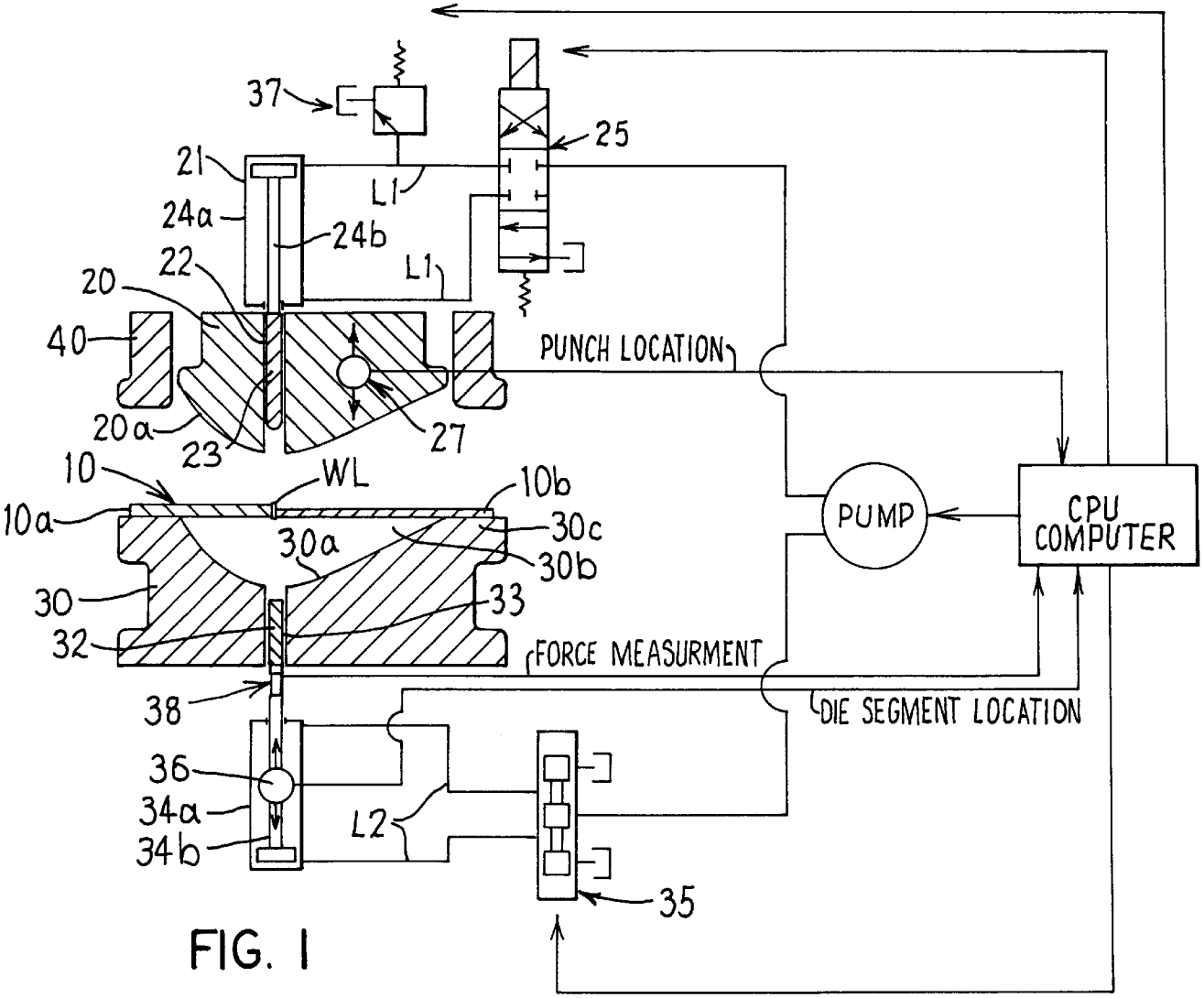
FIG. 1 is a schematic illustration of press apparatus pursuant to an embodiment of the invention for practicing a method embodiment of the invention.
Figure 3:
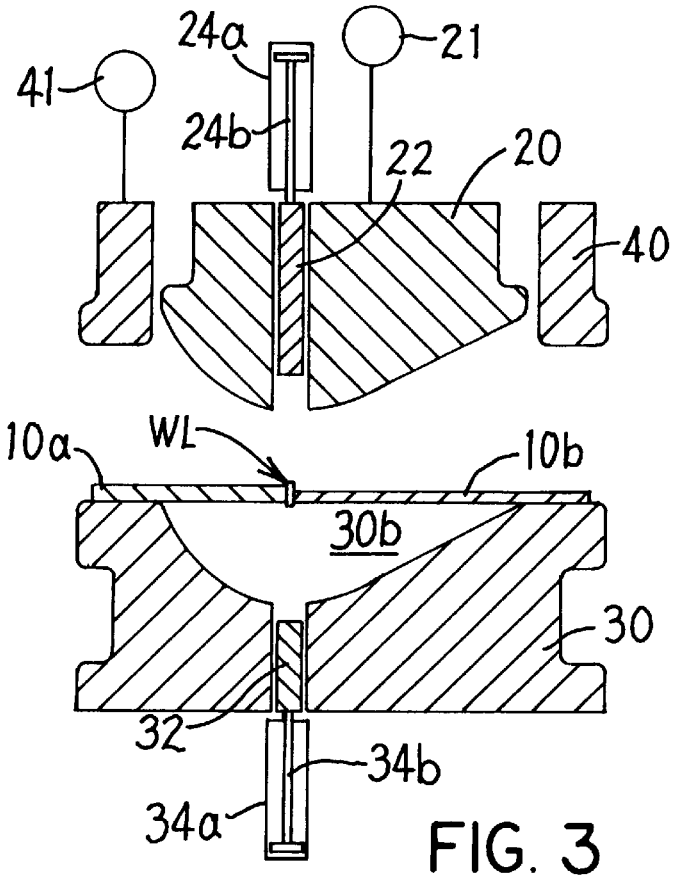
FIG. 3 is a schematic illustration, in partial section, of press apparatus pursuant to an embodiment of the invention having multiple hydraulic cylinders/pistons on the punch and die for controlling movement of respective punch and die segments.

Referring to FIG. 1, The hydraulic cylinders/pistons 24*a*/24*b* are connected by a pair of hydraulic lines L1 to hydraulic 4-way directional valve 25 controlled by a computer or other control unit CPU. The 4-way directional valve can comprise a model series A4D01 directional valve available from Dennison Hydraulics, Marysville, Ohio, connected to a hydraulic fluid pressure source or pump.

The location of the punch 20 relative to the die 30 is sensed by the punch displacement sensor 27 to provide signals to the control unit CPU representative of the location or position of the punch 20 relative to the die 30. The displacement sensor 27 can comprise a conventional position transducer, such as, for example, the Fastur inductive sensor available from Data Instruments, Acton, Mass. The sensor 27 includes a sensor section that is mounted to the moving punch 20 and another sensor section that is mounted to a stationary portion of the press to sense displacement of the punch 20. Alternately, measurements of punch location could be obtained by monitoring gear angular displacement of a mechanical press with a conventional angular position transducer; for example, a WPM sensor from Data instruments, Action, Mass. can be used. This embodiment of sensor 27 would be mounted in the drive train of the mechanical press as a means to sense displacement of the punch 20.

The hydraulic cylinders 34*a* and associated double-acting pistons 34*b* are connected or communicated by a pair of hydraulic lines L2 to a closed loop electrical feedback hydraulic control servovalve 35 controlled by the control unit CPU. The servovalve 35 can comprise a model D079-120A servovalve available from Moog Inc., East Aurora, N.Y., connected to hydraulic fluid pressure source or pump shown.

The location of the die segments relative to the weld line WL is determined by displacement sensor 36, such as a conventional position transducer, operably associated with each die segment 32 to provide position feedback signals to the control unit CPU representative of the position of die segments 32. Each sensor 36 can be incorporated into the hydraulic cylinder, such as in the HV Series hydraulic cylinders made by Miller Fluid Power, Bensenville, Ill., to sense displacement of each piston 34*b*.

A force sensor 38, such as a CLC Series transducer from Transducer Technologies, Temecula, California, is incorporated in each die segment 32 by appropriately integrating the force sensing transducer between the piston shaft 24*b* and respective die segment 32, or in each piston shaft or die segment, so as to provide force feedback signals to the control unit CPU representative of the force applied by the punch segments 22 and to die segments 32 to the weld line WL, FIG. 2A, 2B, and 2C. The adaptive control of the servovalve 35 and of the proportional pressure relief valve 37 (e.g. Series RE valve from Parker Hannifin Corporation, Cleveland, Ohio) by the control unit CPU provides for the magnitude of the weld line holding force to be controlled and/or varied according to the position of the punch 20.

In forming the tailor welded blank 10 in accordance with an embodiment of the invention, the blank 10 is positioned on the die 30 between the punch 20 and die 30 with the weld line WL spanning the die cavity 30*b* as illustrated for example in FIG. 1 and 2A. The binder 40 is actuated by binder actuator 41 to engage the periphery of the blank 10, FIG. 2B, to hold the blank periphery against movement in conventional manner. The die segments 32 are moved by servovalve 35 under displacement control via the control unit CPU receiving position feedback signals from the displacement sensors 36 to position the die segments 32 in contact with the downwardly facing side of the weld line WL also as shown in FIG. 2B. The CPU then signals directional valve 25 to move punch segments 22 in contact with the upwardly facing side of the weld line WL also as shown in FIG. 2B, which applies a force to the weld line WL. The position control of die segment 32 via displacement sensor 36 will control the servovalve 35 to gradually reach a preset holding or clamping force on the weld line WL at a predetermined initial die segment(s) location.

Then, with the weld line WL held at preset holding force between the punch and die segments 22, 32, the punch 20 is moved relative to the punch segments 22 so that both the punch 20 and punch segments 22 engage the blank 10 as illustrated in FIG. 2C. The punch 20 and die segments 32 are moved in unison by actuator 21 and servovalve 35, respectively, toward the die 30 to at least initally deform the blank 10 into the die cavity 30*b* as illustrated in FIG. 2C. The punch segments 22 follow movement of the punch 20 and die segments 32 to maintain the preset weld line holding force during the initial deformation stage of the blank 10.

The holding or clamping force applied by the punch and die segments 22, 32 to the weld line WL prevents adverse movement of the weld line from the vertical plane defined by and containing the segments 22, 32 during initial stage deformation of the blank 10 without interfering with the blank forming operation.

After a predetermined punch location is reached, the punch segments 22 and die segments 32 are moved relative to the punch 20 and die 30, respectively, away from the weld line WL by control unit CPU (controlling the directional valve 25 and servovalve 35) as illustrated in FIG. 2D. The die segments 32 are returned to their initial positions relative to the die 30 shown in FIG. 2A, 2D by servovalve 35 via control unit CPU under displacement control using position feedback signals from displacement sensor 36. The punch segments 22 are moved by directional valve 25 and control unit CPU to positions that will correspond to their initial positions relative to the punch 20 when the punch 20 is later returned to its initial position illustrated in FIG. 2A.

The punch location that initates retreat of the punch and die segments 22, 32 away from the weld line WL in this manner is stored in the control unit CPU. The punch displacement sensor 27 provides punch position signals to the control unit CPU for determining and initiating movement of the punch and die segments 22, 32 away from the weld line WL. The preset punch location is selected based on empirical deformation behavior of test blanks that indicates that little, if any, harmful weld line movement will occur upon further blank deformation to the desired shape or configuration against the die working surface 30*a*, FIG. 2E.

With the punch and die segments 22, 32 retracted out of engagement with the weld line WL, the punch 20 continues to be moved toward the die 30 to complete deformation of the blank 10 against the die working surface 30*a* as illustrated in FIG. 2E.

At completion of the blank forming operation with the blank formed to the desired shape or configuration against the die working surface 30*a*, FIG. 2E, the punch 20 is withdrawn or moved away from the die 30 to the inital punch start position in preparation for the next blank forming operation, FIG. 2F (also FIG. 2A). The punch 20 is moved relative to the punch segments 22 which already have been returned to their initial positions by directional valve 25 as mentioned hereabove.

The binder 40 is withdrawn to the position shown in FIG. 2F (also FIG. 2A) so that the formed TWB blank 10 can be removed from the die 30. The blank forming operation then can be repeated for a new TWB blank 10 positioned between the punch 20 and die 30 as illustrated in FIG. 2A.

In an alternative embodiment of the invention, the motion of punch segments 22 could be controlled by the servovalve 35 with the displacement and force sensors incorporated at the segments 22, while the motion of the die segments 32 could be controlled by the directional valve 25.

The present invention is advantageous to provide a TWB forming process and apparatus using fewer parts with fewer die sets, less occupied press lines, less operation costs, less transportation cost, fewer part assembly steps, less part storage space, and thus less manufacturing costs.

Although the present invention has been described with respect to certain embodiments thereof, it is to be understood that the force sensors 38 and displacement sensor 36 for sensing weld line holding force and segment location, respectively, can be associated with the punch segments 22, or die segments 32, or both. Moreover, rather than being moved by fluid control directional valve 25 and servovalve 35, the punch and die segments can be moved in the manner described hereabove by electrical motor control devices. By the same token, the directional valve can be replaced by a servovalve. Further, it is to be understood that various other modifications and changes can be made therein within the scope of the invention as set forth in the appended claims.

We claim:

1. A method of forming a metal blank having a weld, comprising:

a) positioning the blank between a punch having a punch working surface for shaping said blank and a movable punch weld-holding segment and a die having a die working surface cooperating with said punch working surface and a movable die weld-holding segment opposing said punch weld-holding segment, said blank being positioned with the weld spanning a cavity defined between said punch and die and located between the movable lunch and die weld-holding segments, b) applying a holding force to said weld by moving said movable punch weld-holding segment independently past said punch working surface and moving said movable die weld-holding segment independently past said die working surface such that; said punch weld-holding segment and die weld-holding segment engage opposite side regions of said weld and apply said holding force thereto, and c) relatively moving said punch and die to at least initially deform said blank with said side regions of said weld held between the punch weld-holding segment and die weld-holding segment to reduce movement of the weld.

2. The method of claim 1 including relatively moving the punch weld-holding segment and die weld-holding segment during initial deformation to maintain said holding force on the weld.

3. The method of claim 1 including in step c), sensing holding force applied to said weld by said punch and die weld-holding segments and controlling movement of the punch weld-holding segment and die weld-holding segment in response to sensed holding force to maintain said holding force at a selected holding force value.

4. The method of claim 3 wherein movement of one of said punch and die weld-holdinq segments is controlled based on a force sensor operably associated therewith and by a control unit receiving signals from said force sensor.

5. The method of claim 4 wherein movement of said punch is controlled based on sensed displacement thereof and movement of said die weld-holding segment is controlled based on sensed force at said die weld-holding segment and by a control unit for receiving signals representative of said sensed displacement and said sensed force.

6. The method of claim 1 including in step c), controlling movement of the punch weld-holding segment and die weld-holding segment to maintain the weld in a plane defined by the punch and die weld-holding segments.

7. The method of claim 1 wherein said punch weld-holding segment is retracted independently of said punch working surface away from the weld so as to disengage therefrom at a preset punch location prior to completion of deformation of said blank.

8. The method of claim 1 wherein said die weld-holding segment is retracted independently of said die working surface away from the weld so as to disengage therefrom at a preset punch location prior to completion of deformation of said blank.

9. The method of claim 1 including the further step of further deforming said blank with said punch and die working surfaces engaged with said blank and with said punch weld-holding segment and said die weld-holding segment disengaged from the weld.

10. Apparatus for forming a metal blank having a weld, comprising:

a) a punch having a working surface for shaping the blank and at least one movable punch weld-holding segment for engaging a side region of said weld, b) actuator means for moving said at least one punch weld-holding segment independently of said punch working surface, c) a die having a die working surface for cooperating with said punch working surface and at least one movable die weld-holding segment for engaging an opposite side region of the weld, and d) actuator means for moving said at least one die weld-holding segment independently of said die working surface, e) means for relatively moving said punch and die to at least initially deform said blank with said plunch and die working surfaces while said side regions of said weld are held between the punch weld-holding segment and die weld-holdinq segment to reduce movement of the weld.

11. The apparatus of claim 10 including means for sensing force applied by the punch and die weld-holding segments on the weld and a control unit for receiving signals representative of sensed force for moving at least one of said punch and die weld-holding segments in response to sensed force to apply a holding force on the weld during said initial deformation of said blank to reduce movement of the weld.

12. The apparatus of claim 10 wherein said punch weld-holding segments and die weld-holding segments define a plane in which the weld is held during at least initial deformation of said blank.

13. The apparatus of claim 11 wherein said means for sensing force comprises a force sensor operably associated with the punch or die weld-holding segments.

14. The apparatus of claim 10 including a displacement sensor operably associated with the punch or die segment.

15. The apparatus of claim 10 wherein said actuator means comprises fluid actuator means for moving the punch weld-holding segment.

16. The apparatus of claim 10 wherein said actuator means comprises fluid actuator means for moving the die weld-holding segment.

17. The apparatus of claim 10 including a plurality of the punch weld-holding segments and die weld-holding segments for engaging a plurality of opposite side regions of the weld along its length.

18. The apparatus of claim 10 wherein the punch and die weld-holding segments are retractable independently of said punch and die working surfaces, respectively, away from the weld at a preset punch location prior to completion of deformation of said blank.

* * * * *

UNITED STATES PATENT AND TRADEMARK OFFICE

CERTIFICATE OF CORRECTION

PATENT NO. : 5,941,110

DATED : August 24, 1999

INVENTOR(S) : Jian CAO et al.

It is certified that error appears in the above-identified patent and that said Letters Patent is hereby corrected as shown below:

Column 7, line 56;
"lunch" should be -punch--.

Signed and Sealed this

Eighteenth Day of January, 2000

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO. : 5,941,110
DATED : August 24, 1999
INVENTOR(S) : Jian Cao et al.

It is certified that error appears in the above-identified patent and that said Letters Patent is hereby corrected as shown below:

Title page,
Item [73], please replace "[73] Assignee: Northern University, Evanston, Ill." with -- [73] Assignee: Northwestern University, Evanston, Ill. --.

Column 7,
Line 56, "lunch" should be -- punch --.

Signed and Sealed this

Sixteenth Day of September, 2003

JAMES E. ROGAN
*Director of the United States Patent and Trademark Office*